US010473125B2

(12) United States Patent
Nakajima et al.

(10) Patent No.: US 10,473,125 B2
(45) Date of Patent: Nov. 12, 2019

(54) HYDRAULIC ACTUATOR CONTROL CIRCUIT

(71) Applicant: Caterpillar SARL, Geneva (CH)

(72) Inventors: Hideki Nakajima, Tokyo (JP); Shuhei Orimoto, Tokyo (JP); Naoki Kuroda, Hyogo (JP)

(73) Assignee: Caterpillar SARL, Geneva (CH)

( * ) Notice: Subject to any disclaimer, the term of this patent is extended or adjusted under 35 U.S.C. 154(b) by 41 days.

(21) Appl. No.: 15/548,841

(22) PCT Filed: Feb. 4, 2016

(86) PCT No.: PCT/EP2016/052367
§ 371 (c)(1),
(2) Date: Aug. 4, 2017

(87) PCT Pub. No.: WO2016/124685
PCT Pub. Date: Aug. 11, 2016

(65) Prior Publication Data

US 2018/0017087 A1 Jan. 18, 2018

(30) Foreign Application Priority Data

Feb. 6, 2015 (JP) ..... 2015-021794

(51) Int. Cl.
*F15B 11/10* (2006.01)
*F15B 11/044* (2006.01)
(Continued)

(52) U.S. Cl.
CPC ..... *F15B 11/10* (2013.01); *E02F 9/2225* (2013.01); *E02F 9/2228* (2013.01);
(Continued)

(58) Field of Classification Search
CPC ..... F15B 11/024; F15B 11/042; F15B 11/044; F15B 11/163; F15B 11/165
See application file for complete search history.

(56) References Cited

U.S. PATENT DOCUMENTS 5,168,705 A * 12/1992 Hirata ..... E02F 9/2232 60/452
5,333,449 A * 8/1994 Takahashi ..... E02F 9/2232 60/427
(Continued)

FOREIGN PATENT DOCUMENTS

| | | | |
|---|---|---|---|
| EP | 0445703 | A2 | 9/1991 |
| EP | 2610503 | A2 | 7/2013 |
| JP | 5-41764 | | 1/1989 |
| JP | H06117404 | | 4/1994 |
| JP | H11-303814 | A | 11/1999 |
| JP | 2002206510 | | 7/2002 |
| JP | 2007-177798 | A | 7/2007 |

(Continued)

*Primary Examiner* — Michael Leslie

(57) ABSTRACT

To reduce the cost by reducing the number of parts and simplify the control of regeneration in the hydraulic actuator even though the meter-in control and the meter-out control can be performed separately while the supply and the discharge of hydraulic fluid is controlled. A meter-in valve that controls supply flow from a hydraulic pump into a hydraulic cylinder is provided, and meter-out switching valve that switches the direction of supply and discharge of the hydraulic oil into the hydraulic cylinder and controls the discharge flow from the hydraulic cylinder to the oil tank is installed on the down stream side of the meter-in valve, and further, a regeneration control valve is installed on the down stream side of the meter-out switching valve.

15 Claims, 2 Drawing Sheets

(51) Int. Cl.

| | |
|---|---|
| ***F15B 11/024*** | (2006.01) |
| ***E02F 9/22*** | (2006.01) |
| ***F15B 11/042*** | (2006.01) |
| ***F15B 21/14*** | (2006.01) |

(52) U.S. Cl.

CPC ..... *E02F 9/2267* (2013.01); *F15B 11/024* (2013.01); *F15B 11/042* (2013.01); *F15B 11/044* (2013.01); *F15B 21/14* (2013.01); *F15B 2211/3058* (2013.01); *F15B 2211/30535* (2013.01); *F15B 2211/327* (2013.01); *F15B 2211/351* (2013.01); *F15B 2211/353* (2013.01); *F15B 2211/41509* (2013.01); *F15B 2211/41563* (2013.01); *F15B 2211/426* (2013.01); *F15B 2211/455* (2013.01); *F15B 2211/46* (2013.01); *F15B 2211/465* (2013.01); *F15B 2211/56* (2013.01); *F15B 2211/6313* (2013.01); *F15B 2211/6336* (2013.01); *F15B 2211/6654* (2013.01); *F15B 2211/7053* (2013.01)

(56) References Cited

U.S. PATENT DOCUMENTS

| | | | | |
|---|---|---|---|---|
| 7,066,446 | B2 * | 6/2006 | Nielsen | F15B 11/042 251/129.08 |
| 7,487,707 | B2 * | 2/2009 | Pfaff | F15B 11/003 91/437 |
| 7,905,088 | B2 * | 3/2011 | Stephenson | E02F 9/2217 60/414 |
| 8,505,581 | B2 * | 8/2013 | Matsuo | G05D 7/0635 91/448 |
| 8,631,650 | B2 * | 1/2014 | Verkuilen | E02F 9/2235 60/422 |
| 9,290,912 | B2 * | 3/2016 | Wen | F15B 1/027 |
| 2014/0318116 | A1 * | 10/2014 | Ito | B62D 5/065 60/422 |

FOREIGN PATENT DOCUMENTS

| | | | |
|---|---|---|---|
| JP | 5-214450 | B2 | 6/2013 |
| JP | 2013-170377 | A | 9/2013 |
| WO | 2013/081213 | A1 | 6/2013 |

* cited by examiner

HYDRAULIC ACTUATOR CONTROL CIRCUIT

CROSS-REFERENCE TO RELATED APPLICATIONS

This application is a national phase application of International Patent Application No. PCT/EP2016/053267 filed Feb. 4, 2016, which claims priority to Japanese Patent Application No. 2015-021794 filed Feb. 6, 2015, both of which are incorporated by reference herein in their entireties for all purposes.

TECHNICAL FIELD

The present invention relates to the technical field of a hydraulic actuator control circuit for controlling supply and discharge of oil to and from a hydraulic actuator provided in a construction machine such as an excavator.

BACKGROUND ART

In general, various hydraulic actuators are provided in construction machines such as excavators. As a control circuit for controlling supply and discharge of oil to and from such a hydraulic actuator, a control circuit has been known which is configured to simultaneously perform, using one spool valve, directional control that switches between the direction of supply of hydraulic oil to the hydraulic actuator and the direction of discharge of hydraulic oil from the hydraulic actuator, meter-in control that controls a supply flow rate from a hydraulic pump to the hydraulic actuator, and meter-out control that controls a discharge flow rate from the hydraulic actuator to an oil tank. However, when the meter-in control and the meter-out control are thus performed using one spool valve, a relation between a meter-in opening area and a meter-out opening area with respect to a moving position of the spool valve is uniquely determined. This causes a problem in that the relation between the meter-in and the meter-out cannot be changed in accordance with the contents of work and an operator.

Thus, a technique has been known in which the control of supply and discharge of oil to and from the hydraulic actuator is performed by a bridge circuit formed using four metering valves including a head-side meter-in valve and a rod-side meter-in valve (a head-end supply valve and a rod-end supply valve) that control supply flow rates from the hydraulic pump to a head-side oil chamber of a hydraulic cylinder and to a rod-side oil chamber of the hydraulic cylinder, respectively, and a head-side meter-out valve and a rod-side meter-out valve (a head-end drain valve and a rod-end drain valve) that control discharge flow rates from the head-side oil chamber and from the rod-side oil chamber to the oil tank, respectively (see, for example, PTL 1). In this technique, the four metering valves are individually actuated based on commands from a controller. Thus, the relation between the meter-in and the meter-out can be easily changed in accordance with the contents of work and the operator.

Moreover, the bridge circuit using the four metering valves enables recycling such that discharged oil from one of the oil chambers of the hydraulic actuator is supplied to the other oil chamber. When the recycling is performed, both the head-side and rod-side meter-in valves are opened to merge the discharged oil from one of the oil chambers with pump discharge oil via one of the meter-in valves, and the merged hydraulic oil is then supplied to the other oil chamber via the other mere-in valve.

On the other hand, as another technique that individually performs the meter-in control and the meter-out control on the hydraulic actuator, a technique is also known in which a meter-in selector valve that switches a port of the hydraulic actuator connected to the hydraulic pump while controlling a supply flow rate to the port and a meter-out selector valve that switches a port of the hydraulic actuator connected to the oil tank while controlling a discharge flow rate from the port are provided, and the meter-in selector valve and the meter-out selector valve are independently controlled (see, for example, PTL 2).

CITATION LIST

Patent Literature

[PTL 1] Japanese Patent No. 5214450
[PTL 2] Japanese Patent Application Laid-open No. H11-303814

SUMMARY OF INVENTION

Technical Problem

However, in the configuration in which the control of supply and discharge of oil to and from the hydraulic actuator is performed using the four metering valves as in PTL 1, in addition to four spools (or poppets) forming the respective four metering valves, four actuators (in PTL 1, solenoids) allowing the spools to be moved are needed, disadvantageously leading to a large number of components and increased costs. Moreover, in PTL 1, when both meter-in valves are opened to perform the recycling as described above, recycling oil passes through the two meter-in valves, making the control of a recycling flow rate difficult to control. Furthermore, the total flow rate of the recycling flow rate and the pump flow rate passes through the other meter-in valve, resulting in the need for a larger opening and in an increased valve size.

In contrast, the control circuit in PTL 2 has fewer components than the hydraulic actuator in PTL 1 but needs, besides two spools forming the respective two selector valves of the meter-in selector valve and the meter-out selector valve, a total of four actuators (in Patent Literature 2, electromagnetic proportional pressure control valves) allowing each of the spools to be moved in both directions. Thus, a further reduction in the number of components has been desired, and this is an object of the present invention.

Solution to Problem

The present invention has been developed in view of the above-described circumstances. An invention in claim 1 is a hydraulic actuator control circuit for controlling supply and discharge of oil to and from a hydraulic actuator, the hydraulic actuator control circuit including a meter-in valve that controls a supply flow rate from a hydraulic pump to the hydraulic actuator, and a meter-out selector valve arranged downstream of the meter-in valve to switch between a direction of supply of hydraulic oil td the hydraulic actuator and a direction of discharge of hydraulic oil from the hydraulic actuator while controlling a discharge flow rate from the hydraulic actuator to an oil tank.

An invention in claim 2 is the hydraulic actuator control circuit in claim 1 characterized in that a pressure compensation valve for keeping a pressure difference between an upstream side and a downstream side of the meter-in valve constant is provided upstream of the meter-in valve.

An invention in claim 3 is the hydraulic actuator control circuit in claim 1 characterized in that a recycling control valve for controlling a recycling flow rate at which discharged oil from one of oil chambers of the hydraulic actuator is supplied to the other oil chamber is provided downstream of the meter-out selector valve.

Advantageous Effects of Invention

The invention in claim 1 allows meter-in control and meter-out control to be individually performed, while enabling the number of components to be reduced to contribute to cost reduction.

The invention in claim 2 allows flow rate control to be accurately performed using the meter-in valve.

The invention in claim 3 facilitates control of the recycling flow rate, allowing accurate recycling flow rate control to be achieved.

DESCRIPTION OF EMBODIMENTS

Figure 1:
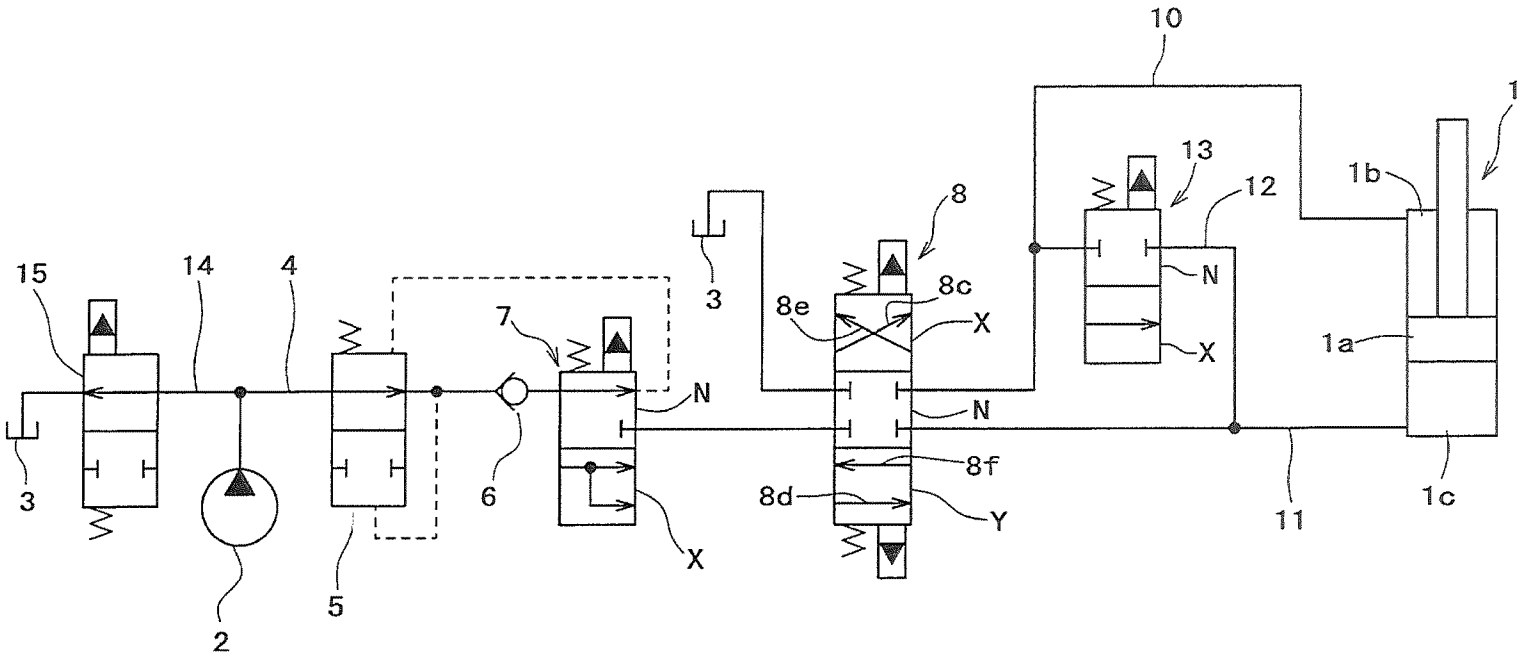
FIG. 1 is a hydraulic circuit diagram depicting a hydraulic actuator control circuit.

An embodiment of the present invention will be described below based on the drawings. FIG. 1 is a hydraulic circuit diagram depicting a hydraulic actuator control circuit for controlling supply and discharge of oil to and from a hydraulic actuator such as a boom cylinder or a stick cylinder which is provided in, for example, an excavator. In FIG. 1, 1 denotes a hydraulic cylinder (in the present embodiment, a stick cylinder in the excavator) serving as a hydraulic actuator, 2 denotes a hydraulic pump serving as a hydraulic pressure supply source of the hydraulic cylinder 1, and 3 denotes an oil tank. The hydraulic cylinder 1 is a double acting cylinder in which a rod-side oil chamber 1*b* and a head-side oil chamber 1*c* are formed on both sides of a piston 1*a*.

Moreover, in FIG. 1, 4 denotes a discharge line for the hydraulic pump 2. In an oil path along the discharge line 4 to the hydraulic cylinder 1, a pressure compensation valve 5, a check valve 6, a meter-in valve 7, and a meter-out selector valve 8 are sequentially disposed in this order from an upstream side.

The pressure compensation valve 5 receives an inlet-side pressure and an outlet-side pressure on the meter-in valve 7 disposed downstream of the pressure compensation valve 5 to control the flow rate so as to keep a pressure difference between an upstream side and a downstream of the meter-in valve 7 constant.

Furthermore, the check valve 6 is configured to permit a flow of oil from the pressure compensation valve 5 to the meter-in valve 7, while inhibiting a flow in the opposite direction.

Furthermore, the meter-in valve 7 is a pilot valve that is pilot-operated by an electromagnetic proportional valve for the meter-in valve 20 (not depicted in FIG. 1) actuated based on control signals output from a controller 9. While the controller 9 is outputting no actuating control signal to the electromagnetic proportional valve for the meter-in valve 20, the meter-in valve 7 is located in a neutral position N where discharged oil supplied from the hydraulic pump 2 via the pressure compensation valve 5 and the check valve 6 is not passed to the meter-out selector valve 8 arranged downstream of the meter-in valve 7. When the controller 9 outputs the actuating control signal to the electromagnetic proportional valve for the meter-in valve 20, the meter-in valve 7 is switched to an actuation position X where the discharged oil from the hydraulic pump 2 is supplied to the hydraulic cylinder 1 via the meter-out selector valve 8. An opening area of the meter-in valve 7 in the actuation position X is controllably increased or reduced based on control signals output from the controller 9 to the electromagnetic proportional valve for the meter-in valve 20. The controllable increase or reduction in the opening area of the meter-in valve 7 enables a controllable increase or reduction in a supply flow rate from the hydraulic pump 2 to the hydraulic cylinder 1. In this case, the pressure compensation valve 5 is actuated to keep the pressure difference between the upstream side and the downstream of the meter-in valve 7 constant. Thus, the flow rate control can be accurately achieved without being affected by a fluctuation in the pressure of the hydraulic pump 2.

Furthermore, the meter-out selector valve 8 is a pilot selector valve that is pilot-operated by a contraction-side electromagnetic proportional valve for the meter-out selector valve 21*a* and an extension-side electromagnetic proportional valve for the meter-out selector valve 21*b* (not depicted in FIG. 1) actuated based on control signals output from the controller 9. While the controller 9 is outputting no actuating control signal to the electromagnetic proportional valves 21*a* and 21*b*, the meter-out selector valve 8 is located in a neutral position N where oil supplied from the meter-in valve 7 is not supplied to the rod-side oil chamber 1*b* or the head-side oil chamber 1*c* of the hydraulic cylinder 1 and where discharged oil from the rod-side oil chamber 1*b* and the head-side oil chamber 1*c* is not passed to the oil tank 3. When the controller 9 outputs the actuating control signal to the contraction-side electromagnetic proportional valve for the meter-out selector valve 21*a*, the meter-out selector valve 8 is switched to a contraction-side actuation position X where a pump flow rate of oil supplied from the meter-in valve 7 is supplied to the rod-side oil chamber 1*b* of the hydraulic cylinder 1 via a rod-side oil path 10 and where oil discharged from the head-side oil chamber 1*c* to a head-side oil path 11 is passed to the oil tank 3. Furthermore, when the controller 9 outputs the actuating control signal to the extension-side electromagnetic proportional valve for the meter-out selector valve 21*b*, the meter-out selector valve 8 is switched to an extension-side actuation position Y where a pump flow rate of oil supplied through the meter-in valve 7 is supplied to the head-side oil chamber 1*c* of the hydraulic cylinder 1 via the head-side oil path 11 and where oil discharged from the rod-side oil chamber 1*b* to the rod-side oil path 10 is passed to the oil tank 3. The opening amounts of the meter-out selector valve 8 in the contraction- and extension-side actuation positions X and Y are such that the opening areas of a contraction-side supply path 8*c* and an extension-side supply path 8*d* through which a pump flow rate of oil is supplied from the meter-out selector valve 8 to the rod-side oil chamber 1*b* of the hydraulic cylinder 1 and to the head-side oil chamber 1*c* of the hydraulic cylinder 1 are set sufficiently larger than the opening area of the meter-in valve 7, whereby the supply flow rate of oil controlled by the meter-in valve 7 is supplied to the rod-side oil chamber 1*b* and the head-side oil chamber 1*c* without being changed. On the other hand, the opening areas of a contraction-side discharge path 8*e* and an extension-side discharge path 8*f* through which discharged oil from the head-side oil chamber 1*c* of the hydraulic cylinder 1 and from the rod-side oil chamber 1*b* of the hydraulic cylinder 1 is passed to the oil tank 3 are controllably increased or reduced based on control signals output from the controller 9 to the contraction-side electromagnetic proportional valve for the meter-out selector valve 21*a* and the extension-side electromagnetic proportional valve for the meter-out selector valve 21*b*. The controllable increase or reduction in the opening area of the meter-out selector valve 8 allows a controllable increase or reduction in the discharge flow rates from the head-side oil chamber 1*c* to the oil tank 3 and from the rod-side oil chamber 1*b* to the oil tank 3. The rod-side oil path 10 is an oil path that couples the meter-out selector valve 8 to the rod-side oil chamber 1*b* of the hydraulic cylinder 1. The head-side oil path 11 is an oil path that couples the meter-out selector valve 8 to the head-side oil chamber 1*c* of the hydraulic cylinder 1.

Moreover, 12 is a recycling oil path located downstream of the meter-out selector valve 8 to allow the rod-side oil path 10 and the head-side oil path 11 to communicate with each other. A recycling control valve 13 is disposed in the recycling oil path 12. The recycling control valve 13 is a pilot selector valve that is pilot-operated by an electromagnetic proportional valve for the recycling control valve 22 (not depicted in FIG. 1) actuated based on control signals output from the controller 9. While the controller 9 is outputting no actuating control signal to the electromagnetic proportional valve for the recycling control valve 22, the recycling control valve 13 is located in a closed position N where the recycling oil path 12 is closed. When the controller 9 outputs the actuating control signal to the electromagnetic proportional valve for the recycling control valve 22, the recycling control valve 13 is switched to an open position X where the recycling oil path 12 is opened to pass discharged oil from the rod-side oil chamber 1*b* of the hydraulic cylinder 1 to the head-side oil chamber 1*c*. The opening area of the recycling control valve 13 in the open position X is controllably increased or reduced based on control signals output from the controller 9 to the electromagnetic proportional valve for the recycling control valve 22. The controllable increase or reduction in the opening area of the recycling control valve 13 allows a controllable increase or reduction in a recycling flow rate from the rod-side oil chamber 1*b* to the head-side oil chamber 1*c* of the hydraulic cylinder 1.

Additionally, 14 is a bypass oil path branching from a discharge line 4 from the hydraulic pump 2 and extending to the oil tank 3. A bypass valve 15 is disposed in the bypass path 14. The bypass valve 15 is a pilot selector valve that is pilot-operated by an electromagnetic proportional valve for the bypass valve 23 (not depicted in FIG. 1) based on control signals output from the controller 9. While the controller 9 is outputting no actuating control signal to the electromagnetic proportional valve for the bypass valve 23, the bypass valve 15 opens the bypass path 14 with the maximum opening area. When the controller 9 outputs the actuating control signal to the electromagnetic proportional valve for the bypass valve 23, the bypass valve 15 closes the bypass path 14. The opening area of the bypass valve 15 is controllably increased or reduced based on control signals output from the controller 9 to the electromagnetic proportional valve for the bypass valve 23. The controllable increase or reduction in the opening area of the bypass valve 15 allows a controllable increase or reduction in the flow rate of the bypass path 14.

Figure 2:
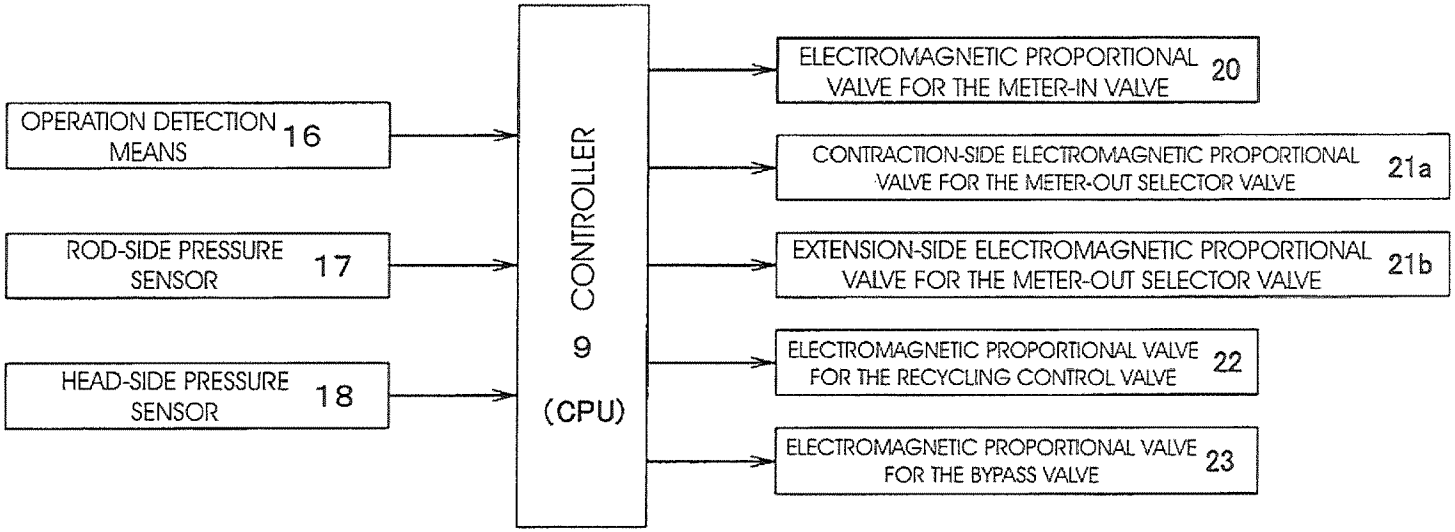
FIG. 2 is a block diagram illustrating inputs to and outputs from a controller.

On the other hand, as depicted in a block diagram in FIG. 2, the controller 9 receives signals from, for example, operation detection means 16 for detecting the operating direction and the amount of operation of a hydraulic-cylinder operation unit (not depicted in the drawings), a rod-side pressure sensor 17 connected to the rod-side oil path 10 to detect a rod-side pressure in the hydraulic cylinder 1, and a head-side pressure sensor 18 connected to the head-side oil path 11 to detect a head-side pressure in the hydraulic cylinder 1. Based on these input signals, the controller 9 outputs control signals to the electromagnetic proportional valve for the meter-in valve 20, the contraction-side electromagnetic proportional valve for the meter-out selector valve 21*a*, the extension-side electromagnetic proportional valve for the meter-out selector valve 21*b*, the electromagnetic proportional valve for the recycling control valve 22, and the electromagnetic proportional valve for the bypass valve 23 to control the meter-in valve 7, the meter-out selector valve 8, the recycling control valve 13, and the bypass valve 15.

Now, control performed by the controller 9 will be described. First, when the hydraulic-cylinder operation unit has not been operated, the controller 9 outputs no actuating control signal to the electromagnetic proportional valve for the meter-in valve 20, the contraction-side electromagnetic proportional valve for the meter-out selector valve 21*a*, the contraction-side electromagnetic proportional valve for the meter-out selector valve 21*b*, the electromagnetic proportional valve for the recycling control valve 22, or the electromagnetic proportional valve for the bypass valve 23. Thus, the meter-in valve 7 is controllably placed in the neutral position N where the discharged oil from the hydraulic pump 2 is not passed to the meter-out selector valve 8. The meter-out selector valve 8 is controllably placed in the neutral position N where the oil supplied through the meter-in valve 7 is not passed to the hydraulic cylinder 1 and where the discharged oil from the hydraulic cylinder 1 is not passed to the oil tank 3. The recycling control valve 13 is controllably placed in the closed position N where the recycling oil path 12 is closed. Thus, oil is not supplied from the hydraulic pump 2 to the hydraulic cylinder 1 or discharged from the hydraulic cylinder 1 to the oil tank 3, the recycling is also not performed, and the hydraulic cylinder 1 is not contracted or extended. Furthermore, the bypass valve bypass valve 15 is controlled to open the bypass path 14 with the maximum opening area, and thus, the hydraulic pump 2 exerts a low discharge pressure.

On the other hand, when the hydraulic-cylinder operation unit is operated to the contraction side, the controller 9 outputs the actuating control signal to the electromagnetic proportional valve for the meter-in valve 20 to controllably place the meter-in valve 7 in the actuation position X. In this case, the opening area of the meter-in valve 7 is controllably increased or reduced based on control signals from the controller 9. Thus, a pump flow rate of oil controlled by the meter-in valve 7 is supplied from the meter-in valve 7 to the meter-out selector valve 8. As described above, the pressure compensation valve 5 is actuated to keep the pressure difference between the upstream side and the downstream side of the meter-in valve 7 constant, allowing for accurate flow rate control.

Moreover, when the hydraulic-cylinder operation unit is operated to the contraction side, the controller 9 outputs the actuating control signal to the contraction-side electromagnetic proportional valve for the meter-out selector valve 21*a* to controllably place the meter-out selector valve 8 in the contraction-side actuation position X. In this case, since the opening area of the contraction-side supply path 8*c* is set sufficiently larger than the opening area of the meter-in valve 7 as described above, a pump flow rate of oil controlled by the meter-in valve 7 is supplied to the rod-side oil chamber 1*b* of the hydraulic cylinder 1 through the contraction-side supply path 8*c*. On the other hand, the oil in the head-side oil chamber 1*c* is discharged to the oil tank 3 through the contraction-side discharge path 8*e* in the meter-out selector valve 8. The opening area of the contraction-side discharge path 8*e* is controllably increased or reduced based on control signals from the controller 9. Thus, a discharge flow rate of oil controlled by the meter-out selector valve 8 flows from the head-side oil chamber 1*c* to the oil tank 3.

Moreover, when the hydraulic-cylinder operation unit is operated to the contraction side, the controller 9 outputs no actuating control signal to the electromagnetic proportional valve for the recycling control valve 22. Consequently, the recycling control valve 13 is controllably placed in the closed position N where the recycling oil path 12 is closed.

When the hydraulic-cylinder operation unit is operated to the contraction side, a pump flow rate of oil controlled by the meter-in valve 7 is supplied to the rod-side oil chamber 1*b* of the hydraulic cylinder 1. On the other hand, the discharged oil from the head-side oil chamber 1*c* is subjected to flow rate control by the meter-out selector valve 8 and then flows to the oil tank 3. Thus, the hydraulic cylinder 1 is contracted. In this case, the controller 9 controllably increases or reduces the opening areas of the meter-in valve 7 and the meter-out selector valve 8 so that the pump flow rate and the discharge flow rate correspond to the amount of operation of the hydraulic-cylinder operation unit. This allows the hydraulic cylinder 1 to be contracted at a speed corresponding to the amount of operation of the hydraulic-cylinder operation unit.

Now, a case where the hydraulic-cylinder operation unit is operated to the extension side will be described. Control varies between a case where the head-side pressure in the hydraulic cylinder 1 is higher than the rod-side pressure in the hydraulic cylinder 1, precluding the recycling from the rod-side oil chamber 1*b* to the head-side oil chamber 1*c*, and a case where the rod-side pressure is higher than the head-side pressure and where the recycling from the rod-side oil chamber 1*b* to the head-side oil chamber 1C is performed. Thus, first, the case where the head-side pressure is higher than the rod-side pressure will be described.

If the hydraulic-cylinder operation unit is operated to the extension side when the head-side pressure in the hydraulic cylinder 1 is higher than the rod-side pressure in the hydraulic cylinder 1, the controller 9 outputs the actuating control signal to the electromagnetic proportional valve for the meter-in valve 20 to controllably place the meter-in valve 7 in the actuation position X. In this case, the opening area of the meter-in valve 7 is controllably increased or reduced based on control signals from the controller 9. Thus, a pump flow rate of oil controlled by the meter-in valve 7 is supplied from the meter-in valve 7 to the meter-out selector valve 8.

Moreover, if the hydraulic-cylinder operation unit is operated to the extension side when the head-side pressure is higher than the rod-side pressure, the controller 9 outputs the actuating control signal to the contraction-side electromagnetic proportional valve for the meter-out selector valve 21*b*. Consequently, the meter-out selector valve 8 is controllably placed in an extension-side actuation position Y. In this case, since the opening area of the extension-side supply path 8*d* is set sufficiently larger than the opening area of the meter-in valve 7 as described above, a pump flow rate of oil controlled by the meter-in valve 7 is supplied to the head-side oil chamber 1*c* of the hydraulic cylinder 1 through the extension-side supply path 8*d*. On the other hand, the oil in the rod-side oil chamber 1*b* is discharged to the oil tank 3 through the extension-side discharge path 8*f*. The opening area of the extension-side discharge path 8*f* is controllably increased or reduced based on control signals from the controller 9. Thus, the discharge flow rate controlled by the meter-out selector valve 8 flows from the rod-side oil chamber 1*b* to the oil tank 3.

If the hydraulic-cylinder operation unit is operated to the extension side when the head-side pressure is higher than the rod-side pressure, the controller 9 outputs no actuating control signal to the electromagnetic proportional valve for the recycling control valve 22. Thus, the recycling control valve 13 is controllably placed in the closed position N where the recycling oil path 12 is closed.

If the hydraulic-cylinder operation unit is operated to the extension side when the head-side pressure is higher than the rod-side pressure (when the recycling from the rod-side oil chamber 1*b* to the head-side oil chamber 1*c* cannot be preformed), a pump flow rate of oil controlled by the meter-in valve 7 is supplied to the head-side oil chamber 1*c* of the hydraulic cylinder 1. On the other hand, the discharged oil from the rod-side oil chamber 1*b* is subjected to flow rate control by the meter-out selector valve 8 and then flows to the oil tank 3. Consequently, the hydraulic cylinder 1 is extended. In this case, the controller 9 controllably increases or reduces the opening areas of the meter-in valve 7 and the meter-out selector valve 8 so that the pump flow rate and the discharge flow rate correspond to the amount of operation of the hydraulic-cylinder operation unit. Thus, the hydraulic cylinder 1 can be extended at a speed corresponding to the amount of operation of the hydraulic-cylinder operation unit.

On the other hand, if the hydraulic-cylinder operation unit is operated to the extension side when the rod-side pressure in the hydraulic cylinder 1 is higher than the head-side pressure in the hydraulic cylinder 1, the controller 9 outputs the actuating control signal to the electromagnetic proportional valve for the meter-in valve 20 and the contraction-side electromagnetic proportional valve for the meter-out selector valve 21*b* as in the case where the head-side pressure is higher than the rod-side pressure as described above. Consequently, the meter-in valve 7 is controllably placed in the actuation position X, whereas the meter-out selector valve 8 is controllably placed in the extension-side actuation position Y. Thus, a pump flow rate of oil controlled by the meter-in valve 7 is supplied to the head-side oil chamber 1*c* of the hydraulic cylinder 1 through the meter-out selector valve 8 in the extension-side actuation position Y. On the other hand, the oil in the rod-side oil chamber 1*b* is discharged to the oil tank 3 through the meter-out selector valve 8 in the extension-side actuation position Y. In this case, the opening areas of the meter-in valve 7 and the meter-out selector valve 8 are controllably increased or reduced based on control signals from the controller 9.

Moreover, if the hydraulic-cylinder operation unit is operated to the extension side when the rod-side pressure is higher than the head-side pressure, the controller 9 outputs the actuating control signal to the electromagnetic proportional valve for the recycling control valve 22 to controllably position the recycling control valve 13 in the open position X. In this case, the opening area of the recycling control valve 13 is controllably increased or reduced based on control signals from the controller 9. Thus, a recycling flow rate of oil controlled by the recycling control valve 13 is supplied from the rod-side oil chamber 1*b* to the head-side oil chamber 1*c* of the hydraulic cylinder 1.

If the hydraulic-cylinder operation unit is operated to the extension side when the rod-side pressure is higher than the head-side pressure, the head-side oil chamber 1*c* of the hydraulic cylinder 1 is supplied with a pump flow rate of oil controlled by the meter-in valve 7 and a recycling flow rate of oil controlled by the recycling control valve 13. On the other hand, the discharged oil from the rod-side oil chamber 1*b* is supplied to the head-side oil chamber 1*c* as the recycling flow rate, and the remaining oil is subjected to flow rate control by the meter-out selector valve 8 and is then discharged to the oil tank 3. Consequently, the hydraulic cylinder 1 is extended. In this case, the controller 9 controls the opening area of the recycling control valve 13 so as to provide the desired recycling flow rate according to the difference between the rod-side pressure and the head-side pressure and the amount of operation of the hydraulic-cylinder operation unit. Further, in order for a flow rate of oil corresponding to the amount of operation of the hydraulic-cylinder operation unit to be supplied to the head-side oil chamber 1*c*, the controller 9 controls the opening area of the meter-in valve 7 so as to provide the pump flow rate equal to a pump flow rate obtained by subtracting the recycling flow rate from the corresponding flow rate. Furthermore, in order for a flow rate of oil corresponding to the amount of operation of the hydraulic-cylinder operation unit to be discharged from the rod-side oil chamber 1*b*, the controller 9 controls the opening area of the extension-side discharge path 8*f* in the meter-out selector valve 8 so as to provide the discharge flow rate equal to a discharge flow rate obtained by subtracting the recycling flow rate from the corresponding flow rate. Thus, the hydraulic cylinder 1 can be extended at a speed corresponding to the amount of operation of the hydraulic-cylinder operation unit.

When the hydraulic-cylinder operation unit is operated to the contraction side or the extension side, the controller 9 outputs the actuating control signal to the electromagnetic proportional valve for the bypass valve 23 to controllably increase or reduce the opening area of the bypass valve 15 in order to adjustably increase or reduce the pump flow rate in association with the opening area of the meter-in valve 7. Thus, a proper amount of discharged oil can be supplied from the hydraulic pump 2 to the meter-in valve 7.

In the present embodiment configured as described above, the hydraulic actuator control circuit for controlling supply and discharge of oil to and from the hydraulic cylinder 1 includes the meter-in valve 7 that controls the supply flow rate from the hydraulic pump 2 to the hydraulic cylinder 1 and the meter-out selector valve 8 arranged downstream of the meter-in valve 7 to switch between the direction of supply of hydraulic oil to the hydraulic cylinder 1 and the direction of discharge of hydraulic oil from the hydraulic cylinder 1 while controlling the discharge flow rate from the hydraulic cylinder 1 to the oil tank 3. The hydraulic oil supplied from the hydraulic pump 2 is subjected to flow rate control by the meter-in valve 7 and is then supplied to the hydraulic cylinder 1 via the meter-out selector valve 8 that switches between the supply direction and the discharge direction. On the other hand, the discharged oil from the hydraulic cylinder 1 is subjected to flow rate control by the meter-out selector valve 8 that switches between the supply direction and the discharge direction and is then discharged to the oil tank 3.

As a result, the control of the supply flow rate from the hydraulic pump 2 to the hydraulic cylinder 1 (meter-in control) is performed by the meter-in valve 7, whereas the control of the discharge flow rate from the hydraulic cylinder 1 to the oil tank 3 (meter-out control) is performed by the meter-out selector valve 8. Thus, the meter-in control and the meter-out control are performed by the individual valves, allowing the relation between the meter-in and the meter-out to be easily changed in association with the contents of work and an operator. Moreover, even though the meter-in control and the meter-out control can be individually performed, the meter-in control, the meter-out control, and the directional control can be performed on the hydraulic cylinder 1 using the two valves of the meter-in valve 7 and the meter-out selector valve 8. Furthermore, the meter-in valve 7 performs only the meter-in control and does not execute the directional control. Consequently, the meter-in valve 7 need not be moved in both directions. Accordingly, movement of the meter-in valve 7 may be achieved exclusively using a single actuator (or a single set of actuators; in the present embodiment, the electromagnetic proportional valve for the meter-in valve 20 or a set of the electromagnetic proportional valve for the meter-in valves 20), enabling the number of components to be reduced to contribute to cost reduction.

Furthermore, on the upstream side of the meter-in valve 7, the pressure compensation valve 5 is provided which keeps the pressure difference between the upstream side and the downstream side of the meter-in valve 7 constant. Thus, the flow rate control can be accurately performed using the meter-in valve 7 without being affected by, for example, a fluctuation in the pressure of the hydraulic pump 2.

Moreover, on the downstream side of the meter-out selector valve 8, the recycling control valve 13 is provided which controls the recycling flow rate at which the discharged oil from one of the oil chambers (in the present embodiment, the rod-side oil chamber 1*b*) of the hydraulic cylinder 1 is supplied to the other oil chamber (in the present embodiment, the head-side oil chamber 1*c*). This enables the pump flow rate to be reduced by an amount equal to the recycling flow rate from one of the oil chambers to the other oil chamber, contributing to energy saving. The recycling control valve 13 is provided independently of the meter-in valve 7 and the meter-out selector valve 8, allowing the recycling flow rate to be easily and accurately controlled.

The present invention is of course not limited to the above-described embodiment. For example, in the above-described embodiment, the meter-in valve, the meter-out selector valve, the recycling control valve, and the bypass valve are pilot selector valves, and the electromagnetic proportional valves are used as actuators that operate the pilot selector valves. However, the meter-in valve, the meter-out selector valve, the recycling control valve, and the bypass valve may be electromagnetic proportional valves directly driven by solenoids.

Furthermore, in the above-described embodiment, the recycling is performed such that the discharged oil from the rod-side oil chamber is supplied to the head-side oil chamber 1*c* when the hydraulic cylinder is extended. However, depending on a load imposed on a working portion driven by the hydraulic cylinder, the orientation of the working portion, and the like, the recycling may be performed such that discharged oil from the head-side oil chamber is supplied to the rod-side oil chamber when the hydraulic cylinder is contracted.

Moreover, in the above-described embodiment, the recycling is controlled so as to make the total flow rate of the recycling flow rate and the pump flow rate equal to the flow rate corresponding to the amount of operation of the hydraulic-cylinder operation unit. However, the recycling may be controlled so as to make the total flow rate of the recycling flow rate and the pump flow rate higher than the flow rate corresponding to the amount of operation of the hydraulic-cylinder operation unit, increasing an actuation speed of the hydraulic cylinder. Such a change in control may be optionally made by changing settings for the controller 9.

INDUSTRIAL APPLICABILITY

The present invention can be utilized for a hydraulic actuator control circuit for controlling supply and discharge of oil to and from a hydraulic actuator such as a hydraulic cylinder.

What is claimed is:

1. A hydraulic actuator control circuit for controlling supply and discharge of oil to and from a hydraulic actuator, the hydraulic actuator control circuit comprising:

a meter-in valve for controlling a supply flow rate from a hydraulic pump to the hydraulic actuator; and a meter-out selector valve arranged downstream of the meter-in valve and configured to switch between a direction of supply of hydraulic oil to the hydraulic actuator and a direction of discharge of hydraulic oil from the hydraulic actuator while controlling a discharge flow rate from the hydraulic actuator to an oil tank, the meter-out selector valve including a first port, a second port, and a third port, the first port of the meter-out selector valve being fluidly coupled to the hydraulic pump via the meter-in valve, the second port of the meter-out selector valve being fluidly coupled to the oil tank along a flow path that does not include the meter-in valve, and the third port of the meter-out selector valve being fluidly coupled to a first port of the hydraulic actuator along a flow path that does not include the oil tank, wherein a first position of the meter-out selector valve effects fluid communication between the first port and the third port along a first meter-out flow passage within the meter-out selector valve, wherein a first position of the meter-in valve effects fluid communication between the pump and the first port of the meter-out selector valve via a first meter-in flow passage within the meter-in valve, and wherein a full-open flow area of the first meter-out flow passage is larger than a full-open flow area of the first meter-in flow passage, such that the first meter-out flow passage does not change the supply flow rate through the meter-in valve.

2. The hydraulic actuator control circuit according to claim 1, further comprising a pressure compensation valve disposed upstream of the meter-in valve for maintaining constant a pressure difference between an upstream side and a downstream side of the meter-in valve, an inlet port of the pressure compensation valve being fluidly coupled to the hydraulic pump along a flow path that does not include the meter-in valve, and the inlet port of the pressure compensation valve being fluidly coupled to an inlet port of the meter-in valve via an outlet port of the pressure compensation valve.

3. The hydraulic actuator control circuit according to claim 1, further comprising a recycling control valve disposed downstream of the meter-out selector valve, the recycling control valve being configured to control a recycling flow rate from a first oil chamber of the hydraulic actuator to a second oil chamber of the hydraulic actuator via the recycling control valve.

4. The hydraulic actuator control circuit according to claim 1, wherein the meter-out selector valve further includes a fourth port, the fourth port of the meter-out selector valve being fluidly coupled to a second port of the hydraulic actuator, and the first port of the hydraulic actuator is fluidly isolated from the second port of the hydraulic actuator by a piston disposed within the hydraulic actuator.

5. The hydraulic actuator control circuit according to claim 4, wherein the first position of the meter-out selector valve further effects fluid communication between the second port of the meter-out selector valve and the fourth port of the meter-out selector valve via a second meter-out flow passage through the meter-out selector valve.

6. The hydraulic actuator control circuit according to claim 5, wherein a second position of the meter-out selector valve effects fluid communication between the first port of the meter-out selector valve and the fourth port of the meter-out selector valve via a third meter-out flow passage through the meter-out selector valve, and effects fluid communication between the second port of the meter-out selector valve and the third port of the meter-out selector valve via a fourth meter-out flow passage through the meter-out selector valve.

7. The hydraulic actuator control circuit according to claim 6, wherein a third position of the meter-out selector valve blocks fluid communication between the first port of the meter-out selector valve and each of the second port of the meter-out selector valve, the third port of the meter-out selector valve, and the fourth port of the meter-out selector valve, and blocks fluid communication between the second port of the meter-out selector valve and each of the third port of the meter-out selector valve and the fourth port of the meter-out selector valve.

8. The hydraulic actuator control circuit according to claim 2, wherein the pressure compensation valve has a first position and a second position, the first position of the pressure compensation valve effecting a first flow restriction between the inlet port and the outlet port of the pressure compensation valve, the second position of the pressure compensation valve effecting a second flow restriction between the inlet port and the outlet port of the pressure compensation valve, the first flow restriction being less than the second flow restriction, and wherein a pressure applied to a first actuation port of the pressure compensation valve biases the pressure compensation valve toward the first position.

9. The hydraulic actuator control circuit according to claim 8, wherein the first actuation port of the pressure compensation valve is fluidly coupled to a first outlet port of the meter-in valve, the first outlet port of the meter-in valve being fluidly coupled to the inlet port of the meter-in valve via a first meter-in flow passage through the meter-in valve.

10. The hydraulic actuator control circuit according to claim 9, wherein the outlet port of the pressure compensation valve is fluidly coupled to the inlet port of the meter-in valve via a first conduit, wherein a pressure applied to a second actuation port of the pressure compensation valve biases the pressure compensation valve toward the second position, and wherein the second actuation port of the pressure compensation valve is fluidly coupled to the first conduit.

11. The hydraulic actuator control circuit according to claim 10, wherein a resilient member of the pressure compensation valve biases the pressure compensation valve toward the first position.

12. The hydraulic actuator control circuit according to claim 9, wherein the meter-in valve includes a second outlet port, the second outlet port of the meter-in valve being in selective fluid communication with the inlet port of the meter-in valve via a second meter-in flow passage through the meter-in valve, a first position of the meter-in valve effects a first flow restriction of the second meter-in flow passage, a second position of the meter-in valve effects a second flow restriction of the second meter-in flow passage, the first flow restriction of the second meter-in flow passage being greater than the second flow restriction of the second meter-in flow passage.

13. The hydraulic actuator control circuit according to claim 12, wherein the first port of the meter-out selector valve is fluidly coupled to the second outlet of the meter-in valve along a flow path that does not include either the oil tank or the hydraulic actuator.

14. The hydraulic actuator control circuit according to claim 12, wherein the first port of the hydraulic actuator is fluidly isolated from the second port of the hydraulic actuator by a piston disposed within the hydraulic actuator.

15. The hydraulic actuator control circuit of claim 1, further comprising a controller operatively coupled to the meter-in valve and the meter-out selector valve, wherein the meter-out selector valve further includes a fourth port, the fourth port of the meter-out selector valve being fluidly coupled to a second port of the hydraulic actuator, wherein the controller is configured to:

actuate the meter-in valve to the first position of the meter-in valve to effect a target flow rate of the hydraulic oil through the first meter-in flow passage, actuate the meter-out selector valve to the first position of the meter-out selector valve while maintaining the meter-in valve in the first position to effect fluid communication between the meter-in valve and the hydraulic actuator without changing the target flow rate of the hydraulic oil through the meter-out selector valve, and effect fluid communication between the second port of the meter-out selector valve and the fourth port of the meter-out selector valve via a second meter-out flow passage within the meter-out selector valve, and actuate the meter-out selector valve to a second position while maintaining the meter-in valve in the first position to effect fluid communication between the meter-in valve and the hydraulic actuator without changing the target flow rate of the hydraulic oil through the meter-out selector valve, and effect fluid communication between the second port of the meter-out selector valve and the fourth port of the meter-out selector valve via the second meter-out flow passage, wherein a fluid restriction of the second meter-out flow passage in the second position of the meter-out selector valve is greater than a fluid restriction of the second meter-out flow passage in the first position of the meter-out selector valve.

* * * * *